United States Patent [19]

Grunwald

[11] Patent Number: 5,063,324

[45] Date of Patent: Nov. 5, 1991

[54] DISPENSER CATHODE WITH EMITTING SURFACE PARALLEL TO ION FLOW

[75] Inventor: Henry C. Grunwald, Bethlehem, Pa.

[73] Assignee: ITT Corporation, New York, N.Y.

[21] Appl. No.: 502,078

[22] Filed: Mar. 29, 1990

[51] Int. Cl.[5] ..... H01J 1/28; H01J 61/09

[52] U.S. Cl. ..... 313/346 DC; 313/630; 313/632

[58] Field of Search ..... 313/346 DC, 609, 632, 313/631, 630

[56] References Cited

U.S. PATENT DOCUMENTS 2,189,636 2/1940 Knowles et al. ..... 313/346 DC
2,452,075 10/1948 Smith ..... 313/346 DC
2,937,303 5/1960 Germeshausen ..... 313/632 X
2,937,304 5/1960 Goldberg et al. ..... 313/631
3,849,690 11/1974 Cosco et al. ..... 313/630

*Primary Examiner*—Palmer C. DeMeo
*Attorney, Agent, or Firm*—Arthur L. Plevy

[57] ABSTRACT

A dispenser cathode for a gas filled tube is fabricated from a porous metal material impregnated with an electron emitting material and has on an emitting surface at least one geometric aperture of a given depth and width and having steep vertical walls which serve to compensate for the deleterious effects of ion back bombardment.

20 Claims, 3 Drawing Sheets

DISPENSER CATHODE WITH EMITTING SURFACE PARALLEL TO ION FLOW

BACKGROUND OF THE INVENTION

This invention relates to dispenser cathodes for use in diffuse gas discharge tubes and more particularly to a dispenser cathode which employs an emitting surface parallel to ion flow.

Dispenser cathodes have been employed for a number of years and generally use a tungsten-base material. The modern dispenser cathode consists of a strongly bonded, continuous metallic phase of a refractory metal or metals such as tungsten. The tungsten cathodes are interspersed uniformly with an emitting material. The porous metal matrix acts as reservoir from which the emitting material can diffuse to the surface to maintain an active layer and consequently provide a low work function surface for the thermionic emission of electrons. This definition excludes oxide coated cathodes, pure metal emitters and thoriated tungsten. Certain dispenser cathodes employ a porous tungsten structure and are impregnated with a molten mixture of barium oxide and other compounds which enhance the emission and lower the work function. The density of the tungsten structure can be varied from 75% to 85% of theoretical by volume.

As indicated, modern dispenser cathodes are well known and for a review and examples of such dispenser cathodes reference is made to an article entitled MODERN DISPENSER CATHODES by J. L. Cronin, published in I.E.E.E. Proceedings, Volume 128, Part 1, No. 1, February 1981, pages 19–32. This article explains the various types of dispenser cathodes which are employed in the prior art as well as the various materials utilized in such cathodes. Thus as one can ascertain, the dispenser cathode has been in existence for quite some time and essentially has been employed in gas discharge tubes such as high power thyratrons and so on. There have been many problems associated with dispenser cathodes as evidenced by examples given in the above noted reference. A major problem associated with such cathodes is caused by ion back bombardment of the dispenser cathode which occurs during tube operation. The bombardment of the cathode structure by ions will deplete the surfaces of the cathode of emitting material. This of course results in low emission until a new active layer migrates up from the bulk. Thus in normal tube operations, ion bombardment of the cathode which is a consequence of the charge transfer in the discharge will deplete the cathode of emitting material and hence substantially reduce the operating capability and life of the cathode and therefore the tube.

It is an object of the present invention to provide a cathode emitting surface which substantially eliminates the detrimental effects of ion back bombardment.

SUMMARY OF THE INVENTION

A dispenser cathode for use in a gas filled electron tube, said cathode having an electron emitting surface with said cathode fabricated from a porous refractory metal interspersed with an electron emitting material, with said cathode when in operation subjected to ion back bombardment which can deplete said electron emitting material from said surface, the improvement therewith comprising at least one groove located on said emitting surface and characterized in having steep vertical walls separated one from the other by a given distance with said groove being a specified depth with respect to said distance to enable said cathode to emit electrons from said steep vertical walls operating to cause bombarding ions which impinge upon the same to cause evaporated emitting material and radiated thermal energy to deposit on the opposite wall, and, to cause secondary electron emission.

DETAILED DESCRIPTION OF THE FIGURES

Figure 1:
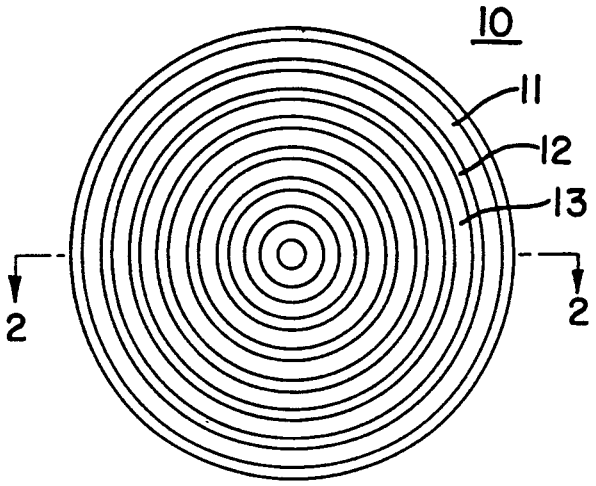
FIG. 1 is a top plan view of a circular vane dispenser cathode according to this invention.

Referring to FIG. 1 there is shown a top plan view of a dispenser cathode according to this invention. As seen the dispenser cathode basically is circular in the top plan view and essentially is of a disk-like configuration as further shown in the cross sectional view of FIG. 2. The cathode includes a relatively large emitting area and for example the diameter of such a cathode can be 3 inches or greater. The cathode is fabricated from a 82% density porous tungsten block structure which is impregnated with a mole ratio of $4BaO:1CaO:1Al_2O_3$. These blocks can be machined to provide a concentric ring geometric configuration. Thus as shown in FIG. 1 the concentric rings or grooves such as 11, 12 and 13 provide a series of upstanding vane structures as shown more readily in the cross sectional view of FIG. 2. Each vane structure such as 15 and 16 is fabricated at a specified height with a specified spacing based on a aspect ratio of approximately 5:1. Thus for example, a typical vane height employed was approximately 0.5 inches with a vane spacing of 0.1 inches based on this aspect ratio of 5:1. The width of the vane or concentric flange was also about 0.1 inches (0.093 inches). This ratio is important to provide a prerequisite for a secondary electron emission factor greater than unity and conservation of thermal energy and coating between the vane side surfaces. As can be seen between each vane there is essentially a void or a well as 17 and 18. These wells are deep enough to allow anode penetration. In this manner the well can not be too deep or there will be no emission from the lower section of the cathode wells. The vertical walls which exist between the vanes enable enhanced emission surfaces but operate to prevent the loss of emission material by ion bombardment. As one can see, the vanes are oriented parallel to the direction of ion flow. Hence the vanes are essentially parallel to the direction of ion flow as denoted by arrow 20 as shown on FIG. 2.

The cathode of FIG. 1 has a diameter of 3 inches. The height of each vane to the circular bottom recess being 0.5 inches and with the typical width of a vane being approximately 0.1 inches as actually being 0.093 inches and with the spacing between vanes being 0.1 inches. The vanes typically have a rounded bottom which defines a radius of 0.05 inches. The configuration which essentially comprises concentric circles is conventionally machined utilizing 82% density tungsten which is impregnated as indicated above. The cathode structures are composed of spongy tungsten which is impregnated with barium aluminate. This compound is commercially available in different ratios and is available from many sources. As can be seen the vertical walls of adjacent vanes face each other. In this manner, if a wall is bombarded by an ion, the emitting material which is depleted from the wall will generally be deposited on the adjacent wall. In this manner the emitting material is not removed but is redeposited. While the term vanes is employed to define the upstanding structures, dispenser cathodes according to this invention are characterized by grooved emitting surfaces. It is the concentric grooves as 11 and 13 which form the vane structures. While grooves are shown it is understood that any aperture configuration which possesses steep vertical walls and generally of the proper aspect ratio will suffice. Thus one can use slots, apertures, or combinations of the same.

Figure 2:
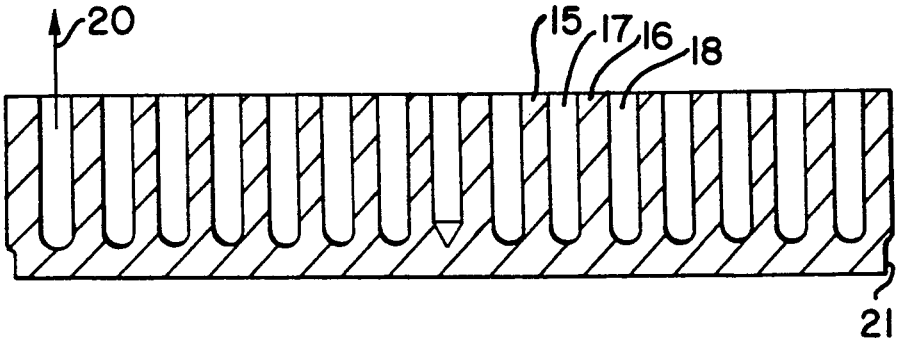
FIG. 2 is a cross sectional view taken through line 2—2 of FIG. 1.
Figure 3:
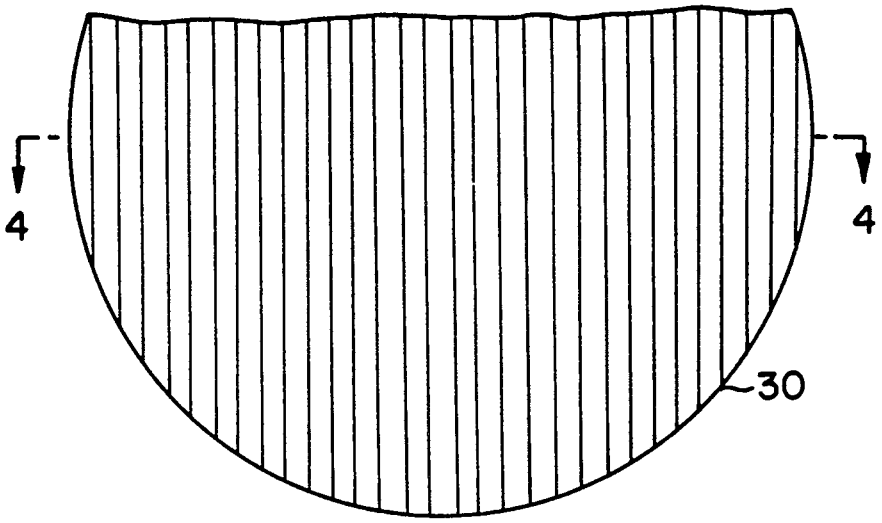
FIG. 3 is a partial top plan view of a straight vane dispenser cathode assembly according to this invention.
Figure 4:
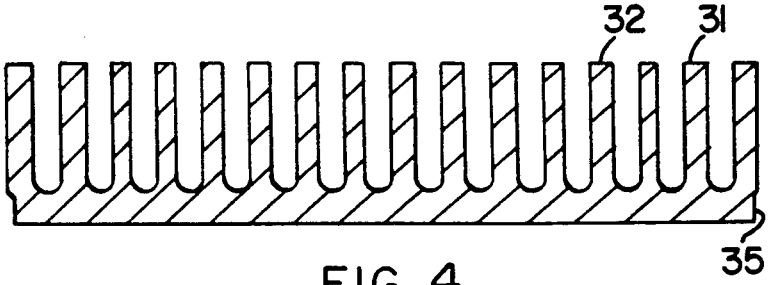
FIG. 4 is a cross sectional view taken through line 4—4 of FIG. 3.

Referring to FIG. 3 there is shown a dispenser cathode, having straight lined grooves on the surface. The vanes as depicted in cross section in FIG. 4 are of the same dimension as those in FIG. 2. The configuration of this cathode is such that it is a dispenser cathode assembly having straight vane configurations as formed by linear grooves located on the cathode surface. As seen, the vane configuration such as 31 and 32 are formed by the straight grooves which are projected across the surface of the cathode. The configuration of the vanes in regard to their height and width are as described above for the circular or concentric vane configuration. The straight vane configurations can also be conveniently machined in the same type of material as the porous tungsten material described above and suitably impregnated. It is found that the aspect ratio for the vanes is approximately 5:1 but this essentially can vary accordingly. The main factor is that each well or separation between the vanes must be deep enough to allow anode penetration. The vertical walls basically operate to enhance emission. Such dispenser cathodes operate with gas filled devices where current moves from the cathode to the anode and ions flow in the opposite direction. Such devices are normally filled with hydrogen as being an extremely light gas or deuterium which is a isotope of hydrogen and sometimes referred to as heavy hydrogen. Thus for current flow in one direction ion flow occurs in the other direction. These ions will collide with the monolayer of emitting material which is on the surface of the cathode disk and eventually deplete the surface of emitting material. Utilizing the vertical vane structure as shown in FIGS. 1 and 3 prevents the ion bombardment from knocking off surface emitting material or effecting cathode operation as existing in the prior art.

Figure 5:
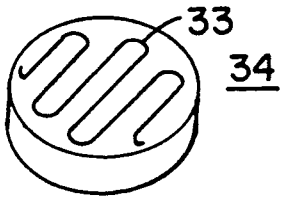
FIG. 5 is a perspective plan view of a dispenser cathode assembly employing serpentine surface configurations to provide vertical vanes.

Referring to FIG. 5 there is shown a dispenser disk cathode structure fabricated from a porous tungsten material as indicated above and in the case of FIG. 5 the dispenser cathode 34 has a serpentine groove configuration located on the surface. The serpentine structure forms upstanding vanes across the surface of the cathode having aspect ratios as indicated above.

Figure 6:
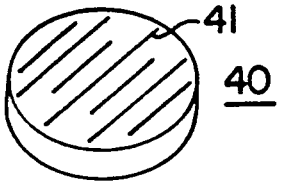
FIG. 6 is a perspective plan view of a dispenser cathode assembly employing partial straight line configurations to form vane assemblies.

FIG. 6 shows slots or grooves which are linear and of different sizes which also form vanes on the surface with spacing similar to that shown in FIGS. 2 and 4. It has been determined that the apertures or grooves which form the vanes can be of any kind of configuration as long as the vane is parallel to the direction of ion flow. Thus, employing one or more groves or slots which are non-horizontal and basically are parallel to the direction of ion flow, one provides a plurality of vertical emitting vanes on the emitting surface of the cathode. It is noted that none of the grooves or slots penetrate through the dispenser cathode. Such dispenser cathodes as indicated above are employed in diffuse gas discharge tubes. The cathodes are normally heated by means of a conventional heater element which is sometimes referred to as a "potato masher" tungsten heater. Such heaters are located within the cathode heat choke which normally is a molybdenum rhenium cylinder. The circular concentric vanes, for example, were fabricated on a 3 inch diameter cathode. The cathode was made from a 82% density porous tungsten block structure which block structure was impregnated with a mole ratio of $4BaO:1CaO:1Al_2O_3$. The blocks were machined into alternate geometric configurations as for example, as shown in FIG. 1 circular concentric vanes of 285 $cm^2$ or the straight vanes as for example shown in FIG. 3 of 270 $cm^2$ total emitting surface area. The vane height was defined as 1.27 centimeters (0.5 inch) and vane spacing at 25.4 mm (0.1 inch) based upon an aspect ratio of 5:1 which is a prerequisite for a secondary electron emission factor greater than unity between the vane side surfaces. Typically a cathode such as those shown in the figures is heated to a temperature of 1050° C. by the potato masher tungsten heater which as indicated is located within the cathode support/heat choke. It is of course understood the above noted dimensions are given by way of example and these dimensions can be employed to in the same proportions for example to make larger or smaller cathode structures. The physical configuration of the cathode essentially comprises a planar low profile vane structure employing concentric rings as shown in FIG. 1 or straight vane dispenser cathode sections as shown in FIG. 3. As one will understand, the configuration of the vanes can be varied and hence one can create such vanes by using serpentine or straight grooves and various other configurations. Normally the cathode which is a disk-like structure will have a heater incorporated into the structure to provide a means of outgassing and activating the material during vacuum processing and operation. The vane thickness, length and spacing is utilized in conjunction with the determination of the optimum type of gas fill. As indicated above, hydrogen was selected due to its inherently low mass, to minimize destructive back ion bombardment of the surface coating. One can also employ deuterium, the rare earth gases as Argon, Neon, Xenon and Helium as well as mixtures of these gases. The type of gas utilized and resultant ion bombardment is a function of the required operating voltage holdoff and deionization properties. As indicated the groove depth and width ratio preferably is about 5:1 but will vary according to the above noted considerations, as for example, dependent upon the type of gas employed in the tube as well as the operating voltage of the same. The grooves can be machined in the porous tungsten material on a lathe or can be formed by brazing techniques. As indicated the grooves can be serpentine, circular, linear, curved and so on as long as they have opposed emitting surfaces for secondary emission, emitting material conservation and thermal efficiency. Thus within known duty cycle, peak current and desired current rise time one can select the cathode parameters regarding the width of the vanes the depth of the vanes, as well as the separation of the vanes.

Figure 7:
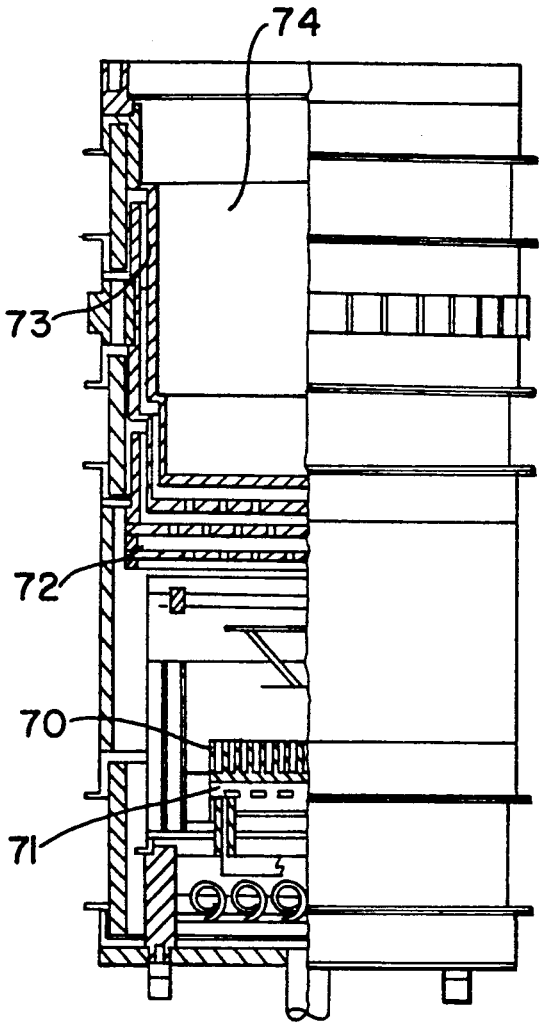
FIG. 7 is a partial cross section view of a thyratron employing a dispenser cathode according to this invention.

Referring to FIG. 7 there is shown a typical cross sectional view of a thyratron utilizing a dispenser cathode 70 according to this invention. As seen the dispenser cathode 70 is located within the thyratron. Essentially the outer shell of the thyratron comprises a plurality of metal and ceramic cylinders which formulate the entire tube structure. Such thyratrons are fairly well known. The cathode rests on a support cylinder 71 which support cylinder is typically brazed to the dispenser cathode on the slightly indented bottom surface of the dispenser cathode, as for example, shown in FIG. 2 by reference numeral 21 and FIG. 4 by reference numeral 35. As seen the bottom of each of the cathodes has a slightly recessed flange onto which the cathode support cylinder is secured by brazing. Typically the cathode support cylinder is 50% molybdneum and 50% rhenium, brazed to the cathode using 60% molybdenum and 40% ruthenium. Located within the cathode support cylinder may be the cathode heater. The remainder of the tube consists of a grid section 72 and anode section 73 with the internal cavity of the thyratron being filled with an appropriate gas 74. The structure shown in FIG. 7 is typical of existing thyratrons essentially consisting of cylinders which have the configuration as shown. The cathode 70 consist of a massive 10.5 centimeters (4.0 inch) diameter, 560 $cm^2$ emitting area fabricated from 82% density porous tungsten block structure which is impregnated with a mole ratio of $4BaO:1CaO:1Al_2O_3$. The tungsten blocks fabricating the cathode were machined to provide concentric ring geometric configurations as for example depicted in FIG. 1 and 2. The vane height was defined as 1.27 centimeters (0.5 inch) with a vane spacing at 25.4 millimeters (0.1 inch) based on aspect ratio of 5:1. This aspect ratio being a prerequisite for secondary electron emission factor greater than unity between the vane side surfaces. The cathode is heated by means of a 750 watt potato masher tungsten heater located within the cathode heat choke which is the support cylinder, as for example, cylinder 71. The cathode is typically heated to 1050° C. As indicated the cathode material is porous barium impregnated tungsten materials which are utilized based on their favorable concurrent properties of low work function (2.2–2.6 ev) and, high melting point (greater than 3680° K.). Physical configuration of the cathode is a planar low profile vane structure of concentric rings or parallel rectangular sections on a common thermally isolated base plate. The cathode can be a brazed assembly or structures machined from single blocks. Thus as one can ascertain from FIG. 7, the emitting surface of the cathode which is the surface that faces the anode is characterized by having a plurality of vanes which are essentially formed by means of concentric circular grooves or straight linear slots on the surface of the cathode which faces the anode. All the cathodes have a closed bottom as indicated in both FIGS. 2 and 4, and the vanes emanate and extend from the closed bottom.

I claim:

1. A dispenser cathode for use in a gas filled tube as an electron emitting surface with said cathode fabricated from a porous refractory metal interspersed with an electron emitting material, with said cathode when in operation subjected to ion back bombardment which undesirably can deplete said electron emitting material from said surface, the improvement herewith comprising:

at least one aperture located on said emitting surface and characterized in having steep vertical walls separated one from the other by a given distance such that said steep vertical walls of said at least one aperture extend to a specified depth not to exceed the thickness of said cathode with respect to said given distance whereby said at least one aperture does not pass through said cathode to enable said cathode to emit electrons when heated with said steep vertical walls operating to cause bombarding ions which impinge upon said wall to cause emitting material to deposit on the opposite wall.

2. The dispenser cathode according to claim 1, wherein said at least one aperture is a groove.

3. The dispenser cathode according to claim 1 wherein there are a plurality of apertures on said emitting surface.

4. The dispenser cathode according to claim 1 wherein said specified depth is about five times said given distance.

5. The dispenser cathode according to claim 1, wherein said refractory metal is tungsten with said electron emitting material being barium aluminate.

6. A dispenser cathode for use in a gas filled electron tube, said cathode having an electron emitting surface with said cathode fabricated from a porous refractory metal interspersed with an electron emitting material, with said cathode when in operation subjected to ion back bombardment which undesirably can deplete said electron emitting material from said surface, the improvement therewith comprising:

at least one groove located on said emitting surface and characterized in having steep vertical walls separated one from the other by a given distance with said at least one groove being a specified depth with respect to said distance to enable said cathode to emit electrons when heated with said steep vertical walls operating to cause bombarding ions which impinge upon said wall to cause emitting material to deposit on the opposite wall.

7. The dispenser cathode according to claim 6 wherein said specified depth is about five times said given distance.

8. The dispenser cathode according to claim 6 wherein said refractory metal is tungsten with said electron emitting material being barium aluminate.

9. The dispenser cathode according to claim 6 including a plurality of grooves located on said emitting surface and spaced one from the other by said given distance.

10. The dispenser cathode according to claim 9 wherein said plurality of grooves are a plurality of concentric circular grooves located on said surface and spaced one from the other by said given distance.

11. The distance cathode according to claim 9, wherein said grooves are a plurality of linear grooves spaced one from the other by said given distance.

12. The dispenser cathode according to claim 6 wherein said at least one groove is a serpentine groove.

13. The dispenser cathode according to claim 6 wherein the ratio of said depth of said at least one groove to said width of said at least one groove is about five to one.

14. The dispenser cathode according to claim 6 further including means for heating the same to a temperature to cause electron emission.

15. The dispenser cathode according to claim 4 wherein said temperature is 1050° C.

16. The dispenser cathode according to claim 6 wherein said metal is 82% density porous tungsten impregnated with a mole ratio of $4BaO:1CaO:1Al_2O_3$ employed as said electron emitting material.

17. The dispenser cathode according to claim 16 wherein said at least one groove machined into said surface.

18. The dispenser cathode according to claim 6 wherein said cathode is a disk-like structure having a top circular emitting surface of a given diameter and a thickness substantially less than said diameter.

19. The dispenser cathode according to claim 6 further including a support member coupled to the side of said cathode for supporting the same in said gas filled electron tube.

20. The dispenser cathode according to claim 6 wherein said gas filled electron tube is a thyratron filled with hydrogen gas.

* * * * *